United States Patent [19]

Simpson

[11] Patent Number: 4,613,300

[45] Date of Patent: Sep. 23, 1986

[54] BURNER SAFETY SYSTEM

[76] Inventor: Kenneth N. Simpson, 9444 SW. Tigard St., Tigard, Oreg. 97223

[21] Appl. No.: 659,084

[22] Filed: Oct. 9, 1984

[51] Int. Cl.[4] ..... F23D 11/36

[52] U.S. Cl. ..... 431/153; 431/59; 431/80; 431/81; 126/374; 126/116 A

[58] Field of Search ..... 431/51, 59, 80, 81, 431/153, 256, 257, 279; 236/1 A, 1 EA, 1 H, 15 R, 15 BR, 15 BF, 48 R, 48 A, 51, 88; 126/374, 116 A; 251/30, 65, 129; 335/1, 2, 6

[56] References Cited

U.S. PATENT DOCUMENTS

| | | | |
|---|---|---|---|
| 2,132,057 | 10/1938 | Thornbery et al. . | |
| 2,290,049 | 7/1942 | Hildebrecht . | |
| 2,431,158 | 6/1941 | Yates . | |
| 2,458,014 | 1/1949 | Matson | 236/1 H X |
| 2,555,411 | 6/1951 | Jones | 431/51 |
| 2,720,623 | 10/1955 | Betz . | |
| 2,909,218 | 10/1959 | Matthews | 431/51 X |
| 3,099,994 | 8/1963 | Putz et al. | 431/59 X |
| 3,224,727 | 12/1965 | Dale et al. | 236/48 A X |
| 3,264,421 | 8/1966 | McIntosh et al. . | |
| 3,393,869 | 7/1968 | Grayson | 236/51 |
| 3,519,376 | 7/1970 | Dietz | 431/51 X |
| 3,597,138 | 8/1971 | Ray . | |

*Primary Examiner*—Larry Jones

*Attorney, Agent, or Firm*—Kolisch, Hartwell & Dickinson

[57] ABSTRACT

Burner apparatus including fuel burners and a pilot light burner associated with each fuel burner. A solenoid-operated valve controls the supply of fuel to the fuel burners. Thermocouples heated by the pilot light burners energize electromagnetic coils that actuate reed switch units closing a circuit to the solenoid-operated valve. A magnet system actuates the reed switch units to close them during start up.

5 Claims, 6 Drawing Figures

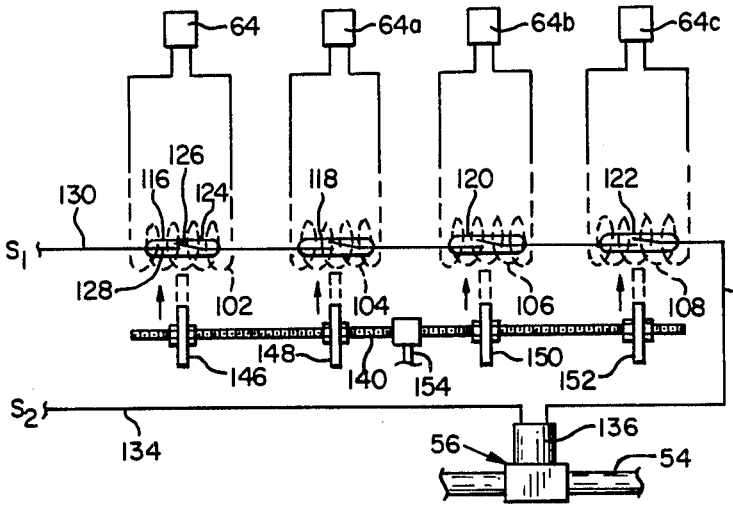
FIG. 6
FIG. 4
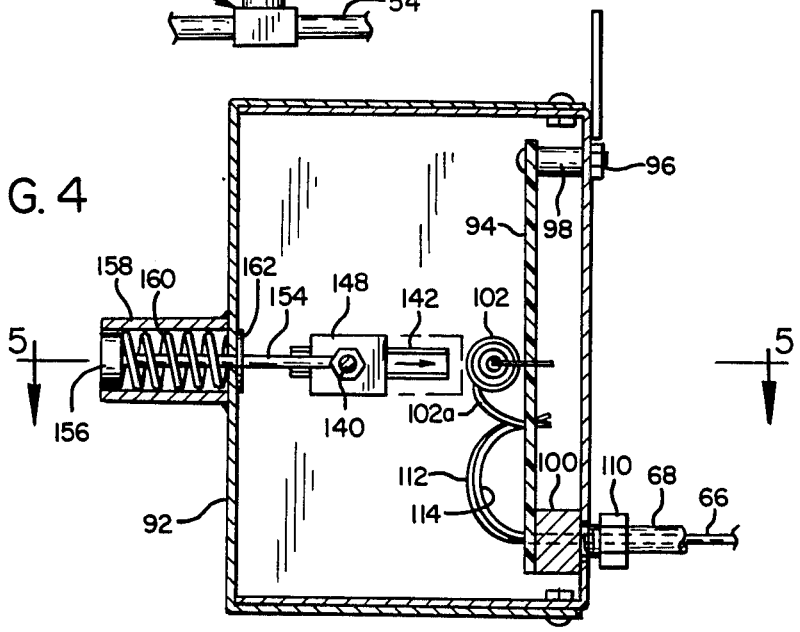
FIG. 5
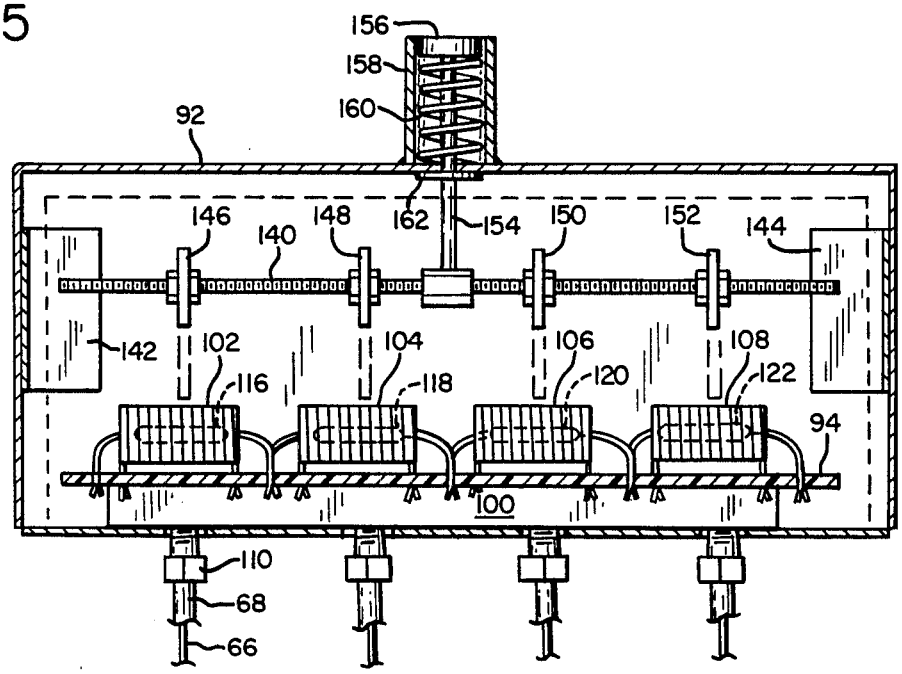

BURNER SAFETY SYSTEM

BACKGROUND AND SUMMARY OF THE INVENTION

This invention relates to burner apparatus, and more particularly to burner apparatus with a control means which operates upon a flame extinguishment occurring in the burner system of the apparatus to shut off a fuel supply valve. This type of control means is important for safety reasons to inhibit accidental explosion or fire.

The invention is particularly described herein in connection with a kiln, and the gas-fired burner system in the kiln provided for heating a chamber within the interior of the kiln. While the invention has thus been particularly described in the specification, it should be understood that with respect to certain features of the invention, such may be beneficially employed in other types of equipment.

There is a substantial market for gas-fired kilns usable by hobbyists, small manufacturers, schools, and like institutions for the making of pottery, tiles, and other ceramic articles. Kilns of this description are supplied as substantially complete packages, which are then installed on-site according to manufacturer's instructions. It is important under such circumstances that the kilns be simple to operate, and highly reliable in order to minimize maintenance requirements. Very importantly, safe operation is a prime consideration, in view of the type of customers involved and the liability exposure if an accident should occur. With kiln installation usually being done by independent installers located at the site of the installation, installation procedures should be simple to follow, and safety features incorporated with the kiln difficult to circumvent. An additional factor to be considered in kiln construction is that frequently operation of a kiln is accompanied with substantial accumulations of dust, which may adversely effect the reliable operation of various parts. And, as is frequently the case with competitively supplied products, price is an important consideration.

A general object of the invention, therefore, is to provide a burner system for a kiln and the like, with improved means responsive to flame extinguishment in the system for shutting off fuel supply to the system.

Another object is to provide an improved kiln featuring a burner system for heating the kiln, and a simple, reliable safety system which assures safe operation of the kiln.

Yet another object of the invention is to provide a burner system for use, for example, with a kiln, incorporating a safety system which is substantially impervious to dust and like accumulations.

Yet another object is to provide burner apparatus including an improved safety system, which is relatively easily, installed and constructed in such a manner as to minimize circumvention of the safety system in the apparatus.

A further object is to provide for a burner system, a safety system which includes an electromagnetic coil energized by a thermoelectric current produced by a thermocouple associated with each burner in the system. The coils when energized actuate respective reed switch units serving to maintain a fuel supply to the burners in the system. A magnet system is provided including magnets brought into close proximity to these reed switch units to produce actuation of the switch units for start up purposes.

These and various other objects and advantages are attained by the invention, which is described hereinbelow in conjunction with the accompanying drawings, wherein:

FIG. 4 is a cross-sectional, view taken generally along the line 4—4 in FIG. 1, and a somewhat enlarged scale, illustrating a control box provided for the kiln, and magnet means within the control box for actuating reed switch units which are part of a control circuit controlling fuel flow to the burners of the burner system;

FIG. 5 is a cross-sectional view taken generally along the line 5—5 in FIG. 4; and FIG. 6 is a schematic illustration of a control circuit controlling fuel flow to the burner system.

Figure 1:
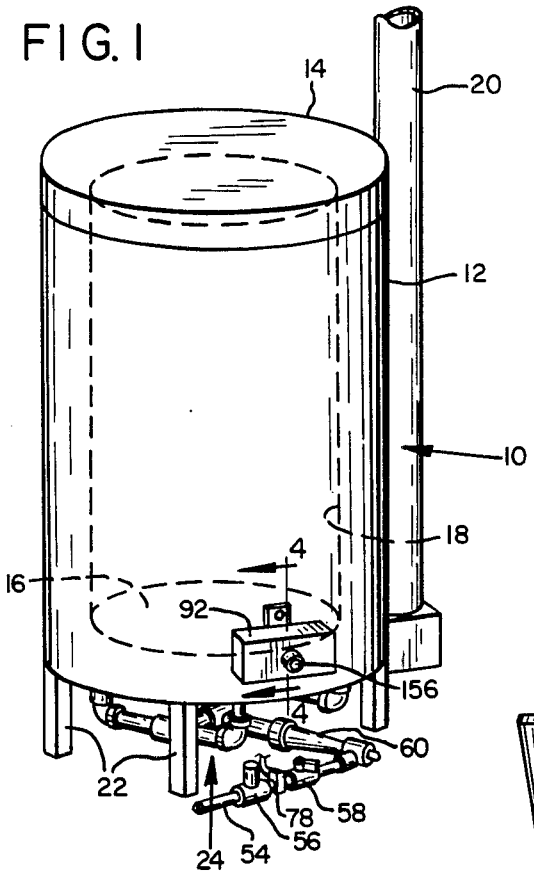
FIG. 1 is a perspective view illustrating in somewhat simplified form a kiln constructed as contemplated by the invention.

Referring now to the drawings, and initially more particularly to FIG. 1, illustrated is kiln structure generally shown at 10 which includes a substantially cylindrical upright shell 12 and a cover 14 forming the top of the kiln structure which is openable to provide access to the interior of the kiln structure. Forming the bottom of the kiln structure is a floor indicated generally at 16 and defined within the kiln structure between the floor and cover is a substantially cylindrical kiln chamber 18.

Floor 16 is suitably apertured (not shown) in the location of fuel burners which are provided in a burner system for heating the kiln. Products of combustion produced by operation of these burners leave the kiln chamber through another aperture (also not shown) connecting with a stack 20.

The kiln structure is supported above the floor on a stand including legs 22. Supported on this stand on the underside of the kiln structure is a gas burner system including a burner manifold shown generally at 24.

Figure 2:
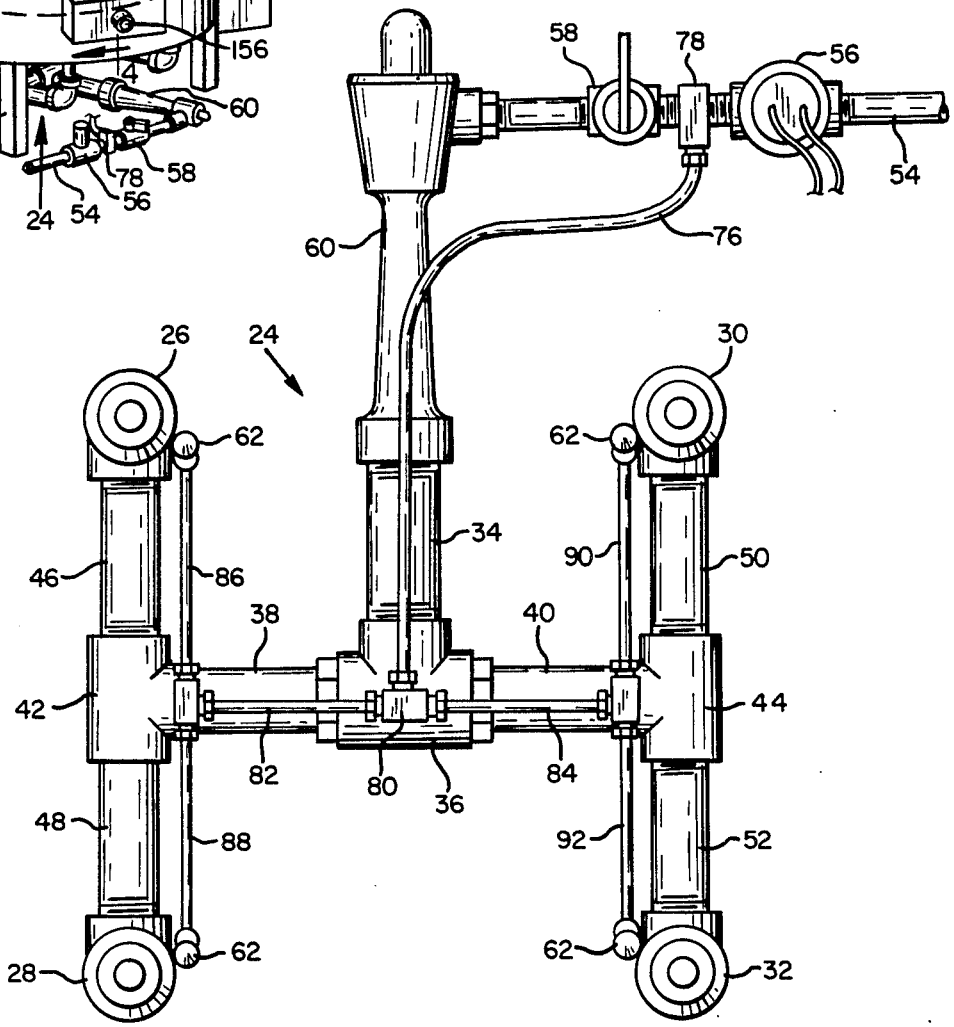
FIG. 2 is a view, on a somewhat larger scale, looking downwardly at burner apparatus in the kiln with such removed from the kiln.

Referring now more particularly to FIG. 2, which is a view looking downwardly at the gas burner system and on a somewhat larger scale, in the embodiment of the invention illustrated such includes four main fuel burners or burner nozzles shown at 26, 28, 30, and 32. A fuel mixture is supplied these burner nozzles through manifold piping including pipe section 34, "T" fitting 36, pipes sections 38, 40, "T" fittings 42, 44, and pipe sections 46, 48, 50, and 52. A fuel, i.e., gas supply line is shown at 54. Gas travels from the gas supply line through a solenoid-operated shut off valve 56, and a manually operated shut off valve 58, to the inlet of an atmospheric mixer assembly shown as 60. A mixture of gas and air travels from this mixer assembly into pipe section 34.

A pilot light burner and thermocouple assembly 62 is mounted adjacent each of the burner nozzles 26–32. Each of these has a construction like that shown in FIG. 3 which illustrates an assembly on a slightly enlarged scale.

Figure 3:
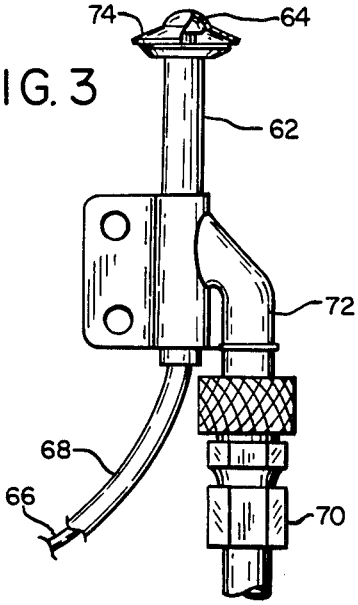
FIG. 3 is a view, on an even larger scale, illustrating a thermocouple and pilot light burner assembly in the apparatus.

Referring to FIG. 3, each assembly 62 includes a thermocouple 64 operable on being heated to produce a thermoelectric current. Current flow is by way of a pair of conductors comprising copper tube 68 which is one conductor, and extending within it and insulted conductor 66.

Assembly 62 is provided with fuel for the pilot light burner through fitting 70 and tube section 72. Fuel travels upwardly from this tube section and into the interior of the assembly, and thence such exhausts to the atmosphere through an annular orifice provided under conical cap 74.

Referring again to FIG. 2, fuel from the fuel supply line 54 is supplied to various pilot light burner and thermocouple assemblies through tube 76 which connects to the fuel line through connector 78. Tube 76 joins through "T" fitting 80 with tubes 82 and 84 and these tubes connect through suitable "T" fittings with tubes 86, 88, 90, and 92. These have their ends joining with the pilot light and burner assemblies through the fitting 70 provided these assemblies.

It should be noted that with operation closing of shut off valve 56, the supply of fuel gas to both the main burners and the pilot light burners is shut off. Opening and closing of manually operated shut off valve 58, on the other hand, only serves to cut off the flow of fuel to the atmospheric mixer assembly.

The various pilot light burner and thermocouple assemblies associated with the burner nozzles control operation of valve 56 through a control panel and associated means illustrated more specifically in FIGS. 4, 5, and 6.

Referring to these figures, and more specifically to FIGS. 4 and 5, a box 92 is illustrated which houses the control panel and much of the circuitry involved. Such box may be mounted directly adjacent the kiln as illustrated in FIG. 1, although obviously other locations and mountings may be provided for the control box.

Mounted within this box 92, in a substantially upright position adjacent the rear wall thereof, is a panel 94. The panel is secured in place by appropriate means including fasteners 96, and spaced from the back wall in the case of the upper part of the panel by spacers 98, and in the case of the lower part of the panel by a bar 100 paralleling the panel's bottom margin.

Mounted on panel 94 and disposed end to end extending therealong are a series of electromagnetic coils corresponding in number to the number of thermocouples in the burner system. These coils are shown at 102, 104, 106, and 108. As exemplified by coil 102, these coils each have end segments such as end segment 102A which extend through the panel to effectuate mounting of the coil in place.

Each thermocouple is connected to a respective coil. Thus, and considering conductors 66 and 68 of a thermocouple shown in FIG. 5, such are electrically connected through a fitting 110 to conductors 112 and 114 which are connected to opposite ends of electromagnetic coil 102. The electric connection produced is as shown in FIG. 6, where the thermocouples for the various pilot burner and, shown at 64, 64*a*, 64*b*, and 64*c*, are each joined through their conductors to opposite ends of respective coils 102, 104, 106, and 108. With the structure described, with a thermocouple such as thermocouple 64 heated by its pilot light, such generates an electric current which passes through its associated coil 102 to energize the coil, with the production of an electromagnetic field by the coil.

Extending through the interior of each coil is a reed switch unit, indicated for the coils 102–108 at 116, 118, 120, and 122. Each reed switch unit comprises a glass envelope such as envelope 124 illustrated in FIG. 6. Within this envelope is a thin flat metal strip or reed such as reed 126. With the coil about the reed switch unit energized, this reed is deflected to come against another contact such as contact 128 within the reed switch unit to close the switch therein.

As illustrated in FIG. 6, the reed switch units within the respective coils are connected in series between conductors 130 and 132. Connected in series between conductors 132 and 134 is solenoid 136 which operates valve 56. Conductors 130 and 134 in turn are connected to power supply leads S1 and S2.

A magnet system is provided for closing the switches of the various reed switch units independently of energizing of the coils associated with the switch units. Specifically, and referring to FIGS. 4 and 5, extending along the interior of box 92 is a rod 140 with ends guided for sliding movement within guide structure 142 and 144 provided at opposite extremities of the box. Mounted on this rod are a series of ceramic magnets 146, 148, 150, and 152. Each is mounted on the rod at a region laterally offset from respective ones of the electromagnetic coils. Connected to rod 40 intermediate its ends is a plunger rod 154 which extends out through a side of box 92 and terminates in a thumb depressor or actuator 156 secured thereto. A sleeve 158 secured to the box provides an enclosure for the thumb depressor and rod attached thereto, as well as for a compression spring 160 interposed between the thumb depressor and a wall of the box serving to bias the assembly upwardly. Limiting outward movement of rod 154 is an abutment 162 secured to the rod which strikes the wall of the box with spring 160 urging actuator 156 to its outermost position.

With the construction described, normally the various magnets 146–152 secured to rod 140 are disposed within the box a considerable distance from the coils that they confront. However, with pressing of the thumb depressor to move the depressor and rod 154 inwardly against the bias of the spring, the magnets are brought into close proximity to the respective coils, and the reed switch units which are lodged within the coils. This positioning of the magnets produces simultaneous closing of all the reed switch units, to complete a circuit from conductor 130 to conductor 132.

Explaining the operation of the apparatus described, with solenoid 136 deenergized, shut off valve 56 is closed shutting off the supply of fuel to the system. To start up the system, manually operated shut off valve 58 is closed. Thumb actuator 156 is then depressed to bring the various magnets supported on rod 40 into close proximity with the coils that they confront. This produces a closed circuit between supply conductors S1 and S2, energizing of solenoid 136, and opening of shut off valve 56.

With this occurring, fuel is introduced to the tube system including tube 76 and tubes connected therewith, to the pilot light burners associated with the various burner nozzles. This enables the pilot light burners to be lit.

The thumb actuator is maintained depressed, ordinarily for a matter of maybe 20 seconds, until the various thermocouples associated with the pilot light burners have been heated to such an extent as to generate a significant thermoelectric current. On such occurring, such current is supplied by the various thermocouples across the electromagnetic coils. This energizes the respective electromagnetic coils sufficiently to cause closing of the reed switch units, the circuit between conductors 130 and 132 then remaining closed. The thumb actuator may then be released, which causes retractive movement of the magnets under the urging of spring 160. Supply valve 58 may then be opened, as pilot flames adjacent all burner nozzles have been established.

In the event that there is a flame extinguishment in any of the pilot light burners, the thermocouple associated with the pilot light burner cools, and the thermocouple ceases to generate significant thermoelectric current. This results in deenergizing of the electromagnetic coil associated with the particular thermocouple, opening of the reed switch unit which is lodged within the coil, opening of the circuit supplying electric current to solenoid 136, and closing of valve 56.

The apparatus described is completely reliable. The system is substantially impervious to dust accumulations. Installation of the kiln structure is relatively simple. The safety system is such that to bypass the system, such must be done intentionally. The components of the system are relatively economically produced.

In some installations, the permanent magnets of the magnet system acutating the reed switch units may be replaced with electromagnetic coils provided with a suitable voltage supply.

While a particular embodiment of the invention has been described, it is obvious that variations and modifications are possible without departing from the invention.

It is claimed and desired to secure by letters patent:

1. In combination with a fuel burner, a pilot light burner disposed adjacent the fuel burner for lighting the fuel burner, and a solenoid-operated valve controlling the supply of fuel to said fuel burner, a thermocouple operable when heated to produce a thermoelectric current placed to be heated by the heat of the pilot light burner, an electromagnetic coil connected across said thermocouple energized by the thermoelectric current of the thermocouple, a reed switch unit including an envelope and switch contacts within said envelope actuated by the application of a magnetic flux thereto, said reed switch being mounted adjacent and in the magnetic field of said coil with energizing of the coil, a magnet, a mounting for said magnet wherein such is spaced from said reed switch unit, said mounting including selectively actuated means operable when actuated to move said magnet into a position of closer proximity to said reed switch unit whereby the switch contacts of the unit are actuated by the magnetic field of the magnet, and circuit means connected to the reed switch unit and actuated by the unit to control actuation of the solenoid of said solenoid-operated valve.

2. The combination of claim 1, and which further includes kiln structure having a kiln chamber defined therewithin, said fuel burner being placed beneath said kiln chamber and operating when ignited to heat the chamber, said electromagnetic coil being located exteriorly and to one side of said kiln structure, said selectively actuated means comprising a manually actuated mechanical means operable when actuated to move said magnet into a position of closer proximity to said reed switch unit, said mechanical means including biasing means operable in the absence of manual actuation to return the magnet to its position spaced from said reed switch unit.

3. A pilot light burner system for controlling operation of multiple fuel burners supplied with fuel through a solenoid-controlled valve, the system comprising multiple pilot light burners adapted to be mounted with one adjacent each burner for lighting the burner, a thermocouple placed adjacent each pilot light burner to be heated by the heat of the pilot light burner and operable when heated to produce a thermoelectric current, a control panel remote from said thermocouples, an array of electromagnetic coils mounted on one side of said panel, a conductor pair connecting each of said magnetic coils to a separate thermocouple, a reed switch unit for each coil, each including an envelope and switch contacts within said envelope actuated by the application thereto of a magnetic flux, circuit means connecting said reed switch units in series and controlled by actuation of the contacts of all of said reed switch units to control actuation of the solenoid of said solenoid-controlled valve, and magnetic means for actuating all of said reed switch units independently of current produced by the thermocouples, said magnetic means comprising a magnet system having an operative adjusted position wherein said reed switch units are actuated and an inoperative adjusted position when the reed switch units are not actuated, and biasing means tending to urge the magnetic system to its inoperative adjusted position.

4. The pilot system of claim 3, which further includes a housing for said control panel, said panel and said electromagnetic coils being mounted within said housing, and wherein said magnet system comprises a magnet for each coil, and a moveable bar mounted within said housing providing a common mounting for said magnets.

5. Apparatus comprising kiln structure having a kiln chamber defined therewithin, a burner system for said kiln structure comprising a fuel burner and a pilot light burner disposed adjacent the fuel burner for lighting the fuel burner, said fuel burner when ignited operating to heat said kiln chamber, a thermocouple heated by heat produced in the burner system and operable when heated to produce a thermoelectric current, a control assembly disposed exteriorly of said kiln chamber and remote from said burner system, such control assembly including an electromagnetic coil connected across said thermocouple and energized by the thermoelectric current of the thermocouple, and a reed switch unit including an envelope with switch contacts within said envelope actuated between open and closed positions, said reed switch unit being mounted adjacent and in the magnetic field of said coil with energizing of the coil, a solenoid-operated valve controlling the supply of fuel to said burner system, circuit means connecting said reed switch unit and the solenoid of said solenoid-operated valve whereby actuation of the solenoid of said valve is controlled by said contacts of said reed switch unit, said control assembly further including magnet means for actuating said reed switch unit independently of current produced by said thermocouple, said magnet means comprising a magnet and a mounting therefor which accommodates movement of said magnet from a position spaced from said coil to a position closely adjacent said coil whereby the flux of said magnet actuates the contacts of said reed switch unit.

* * * * *